US005265857A

United States Patent [19]

Chiang

[11] Patent Number: 5,265,857

[45] Date of Patent: Nov. 30, 1993

[54] AUTOMATIC DOCUMENT FEEDER WITH MECHANICAL CLUTCH MECHANISM

[75] Inventor: Ming-Tong Chiang, Shinchu, Taiwan

[73] Assignee: Industrial Technology Research Institute, Hsinchu, Taiwan

[21] Appl. No.: 977,647

[22] Filed: Nov. 17, 1992

Related U.S. Application Data

[62] Division of Ser. No. 853,822, Mar. 19, 1992, Pat. No. 5,203,553.

[51] Int. Cl.[5] ..... B65H 5/00; B65H 3/06

[52] U.S. Cl. ..... 271/10; 271/116; 271/270

[58] Field of Search ..... 271/10, 114, 116, 270; 400/624, 629

[56] References Cited

U.S. PATENT DOCUMENTS 2,762,623 9/1956 Uthenwoldt et al. ..... 271/116
3,961,786 6/1976 Yanker ..... 271/10 X
4,032,135 6/1977 Ruenzi ..... 271/116
4,529,187 7/1985 Einem et al. ..... 271/116 X
4,927,130 5/1990 Tanaka et al. ..... 271/10
5,141,217 8/1992 Lim et al. ..... 271/270 X

*Primary Examiner*—Robert P. Olszewski
*Assistant Examiner*—Boris Milef
*Attorney, Agent, or Firm*—Fish & Richardson

[57] ABSTRACT

An automatic document feeder of a fax machine has a fully mechanical clutch mechanism. The clutch mechanism employs an assembly of a coil spring and a pair of pulleys respectively affixed to a feeding roller and a dividing roller of the fax machine. The coil spring expands due to a first type torsional deformation so that transmission is engaged to drive both the feeding roller and the dividing roller to feed the document into the fax machine one sheet at a time; and as the coil spring is constricted due to a second type torsional deformation caused at the time when one printed sheet is under scanning for fax transmission, transmission is disengaged to stop the feeding roller.

2 Claims, 5 Drawing Sheets

AUTOMATIC DOCUMENT FEEDER WITH MECHANICAL CLUTCH MECHANISM

CROSS REFERENCE

This is a divisional application of the same entitled application having a Ser. No. 07/853,822 and filed on Mar. 19, 1992 now U.S. Pat. No. 5,203,553.

FIELD OF THE INVENTION

The present invention relates to the mechanism of an automatic document feeder, especially to the mechanism of the automatic document feeder of a fax machine, which uses a mechanical mechanism instead of an electro-mechanical mechanism.

BACKGROUND OF THE INVENTION

The working process of a typical fax machine in fax transmission of a document generally includes the steps as follows:

(1) Separate the first page form the remaining documents;

(2) Feed the first page into scanning means;

(3) Scan the first page at a predetermined speed and send out a serious of codes representing the graphical data of the page according to communication protocols;

(4) Repeat the above steps until no documents remains.

Most fax machines use a combination of an electromagnetic clutch and a single-directional bearing to achieve the purpose of separating and feeding the document papers for accurately scanning the graphical data. However, this increases manufacturing cost of the fax machines, since the electromagnetic clutch and the single-directional bearing are expensive and difficult to assemble.

SUMMARY OF THE INVENTION

It is therefore an object of this invention to provide a structure for the automatic document feeder of the fax machine without the electromagnetic clutch or the single-directional bearing.

It is another object of this invention to provide a structure for the automatic document feeder of the fax machine that is easy to assemble.

The embodied automatic document feeder includes a feeding roller for urging the document downstream and a dividing roller disposed downstream of the feeding roller for allowing only one printed sheet of the document to pass therethrough at a time. A driving shaft is used to drive the feeding roller and the dividing roller; and a clutch is used to engage or disengage the transmission of driving force from the driving shaft. A scanning roller, disposed downstream the dividing roller, is used to urge each printed sheet passing through the driving roller into a scanning position whereat each printed sheet is scanned for fax transmission An outlet roller, disposed downstream the scanning roller, is used to urge each printed sheet exiting the scanning position out of the fax machine. The scanning roller is driven in such a manner that the tangential speed of its outer periphery is greater than the tangential speed of the first outer periphery of the driving roller which is driven by the driving shaft.

The clutch structure is a characterized feature of the present invention. In one preferred embodiment, the clutch includes a socket affixed to the driving shaft, a first pulley affixed one end of the feeding roller, a second pulley affixed to one end of the dividing roller, a belt meshing the two pulleys, and a coil spring coupled between the socket and the dividing roller.

The second pulley has a circular recess having a diameter equal to the diameter of the coil spring so that one end of the coil spring can be inserted into the circular recess. In this way, as the fax machine starts to operate, i.e. the driving shafts starts to rotate with a constant speed, the coil spring is expanded due to a torsional force applied in the opposite of its winding direction, so that the periphery of the coil spring urges against the inner wall of the circular recess of the second pulley such that the coil spring is engaged with the driving roller. The driving roller thus starts to rotates; and the feeding roller also starts to rotates due to the transmission of driving force from the dividing roller by the belt. This cause one sheet of the document to be fed through the dividing roller.

As the input sheet is received by the scanning roller, which is used to guide the sheet into a scanning position where the sheet is scanned to fax transmission, the sheet is urged to advance with a faster speed. If the sheet is still in touch with the dividing roller, the dividing roller will move faster than the coil spring which is driven by the driving shaft. As a result, the coil spring is constricted and thereby detached from the inner wall of the circular recess of the second pulley such that the coil spring is disengaged with the driving roller. Under this condition, the dividing roller, as well as the feeding roller, stop rotating. Until the input sheet is fax transmitted, i.e. the tail-edge of the input sheet leaves the dividing roller, the dividing roller slows down and thereby is again engaged with the driving shaft. The feeding roller thus rotates again to feed in the next page of the document.

BRIEF DESCRIPTION OF THE DRAWINGS

The present invention will become more fully understood from the detailed description given hereinbelow and the accompanying drawings which are given by way of illustration only, and thus are not restrictive of the present invention and wherein.

DETAILED DESCRIPTION OF THE EMBODIMENTS

Figure 1:
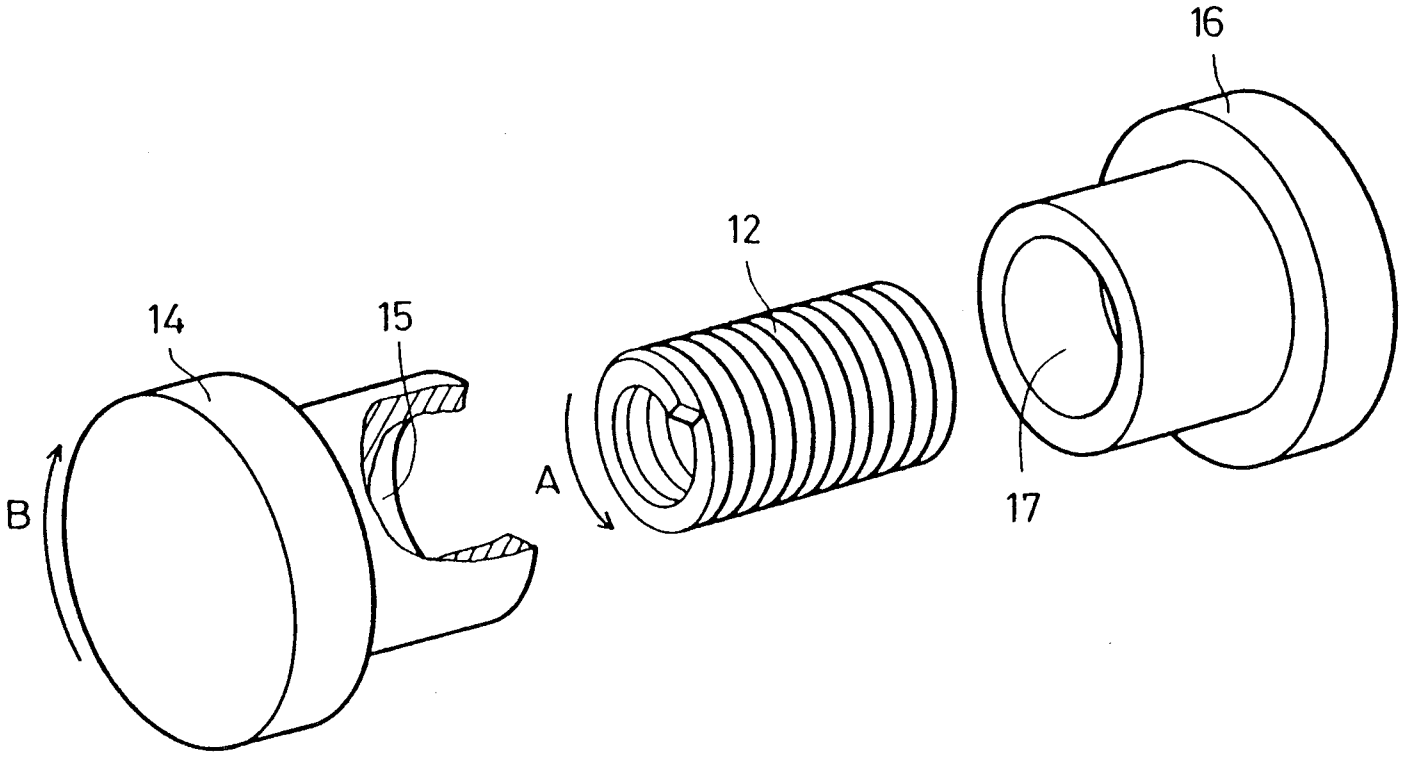
FIGS. 1–2 show how the coil spring works as a clutch.
Figure 2:
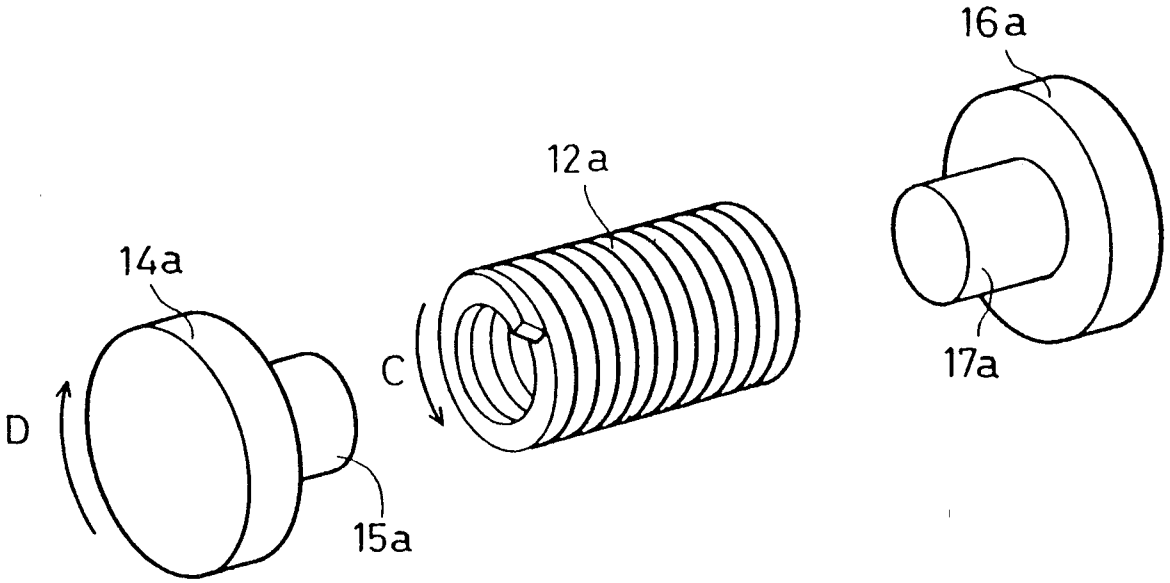

Please refer to FIG. 1 and FIG. 2, the illustrations shown there are used to demonstrate the function of a coil spring clutch employed in the preferred embodiment of the present invention. As shown in FIG. 1, a coil spring 12 is wound in the direction as denoted by an arrow. One end of the coil spring 12 is received in and slightly close fitted in a hole 15 of a driving wheel 14. The other end of the coil spring 12 is received in and slightly close fitted in a hole 17 of a driven wheel 16. If the driving wheel 14 rotates along the direction denoted by an arrow B (the opposite direction of the winding direction of the coil spring 12), then the coil spring 12 will be urged to rotate along with the driving wheel 14 and thereby retract in its diameter so that the driven wheel 16 is disengaged with the coil spring 12. As a result, the driven wheel 16 will not rotate. On the other hand, if the driving wheel 14 rotates along the opposite direction of arrow B (the same direction of the winding direction of the coil spring 12), then the coil spring 12 will be urged to rotate along with the driving wheel 14 and thereby be enlarged in its diameter so that the driven wheel 16 is engaged with spring 12. As a result, the driven wheel 16 will be driven to rotate by the driving wheel 14.

As shown in FIG. 2, a coil spring 12*a* is wound in the direction as denoted by an arrow C. One end of the coil spring 12*a* is sleeved on and slightly close fitted to one end 15*a* of a driving wheel 14*a*. The other end of the coil spring 12*a* is sleeved on and slightly close fitted to one end 17*a* of a driven wheel 16*a*. If the driving wheel 14*a* rotates along the direction denoted by an arrow D (the opposite direction of the winding direction of the coil spring 12*a*), then the coil spring 12*a* will be urged to rotate with the driving wheel 14*a* and thereby retract in its diameter so that the driven wheel 16*a* is engaged with spring 12*a*. As a result, the driven wheel 16*a* will be driven to rotate by the driving wheel 14*a*. On the other hand, if the driving wheel 14*a* rotates along the opposite direction of arrow D (the same direction of the winding direction of the coil spring 12*a*), then the coil spring 12*a* will be urged to rotate by the driving wheel 14*a* and thereby be enlarged in its diameter so that the driven wheel 16*a* is disengaged with the coil spring 12*a*. As a result, the driven wheel 16*a* will not rotate.

Figure 3:
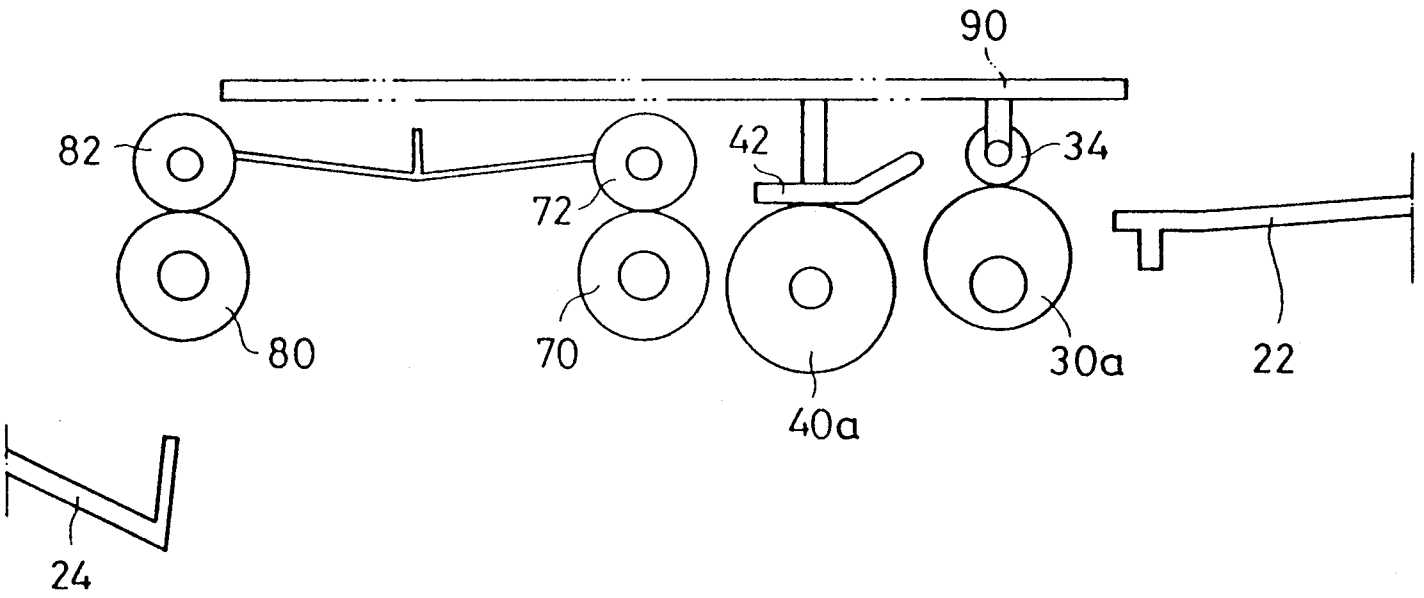
FIG. 3 shows the schematic side elevation of the automatic document feeder of the embodiment of the present invention.
Figure 4:
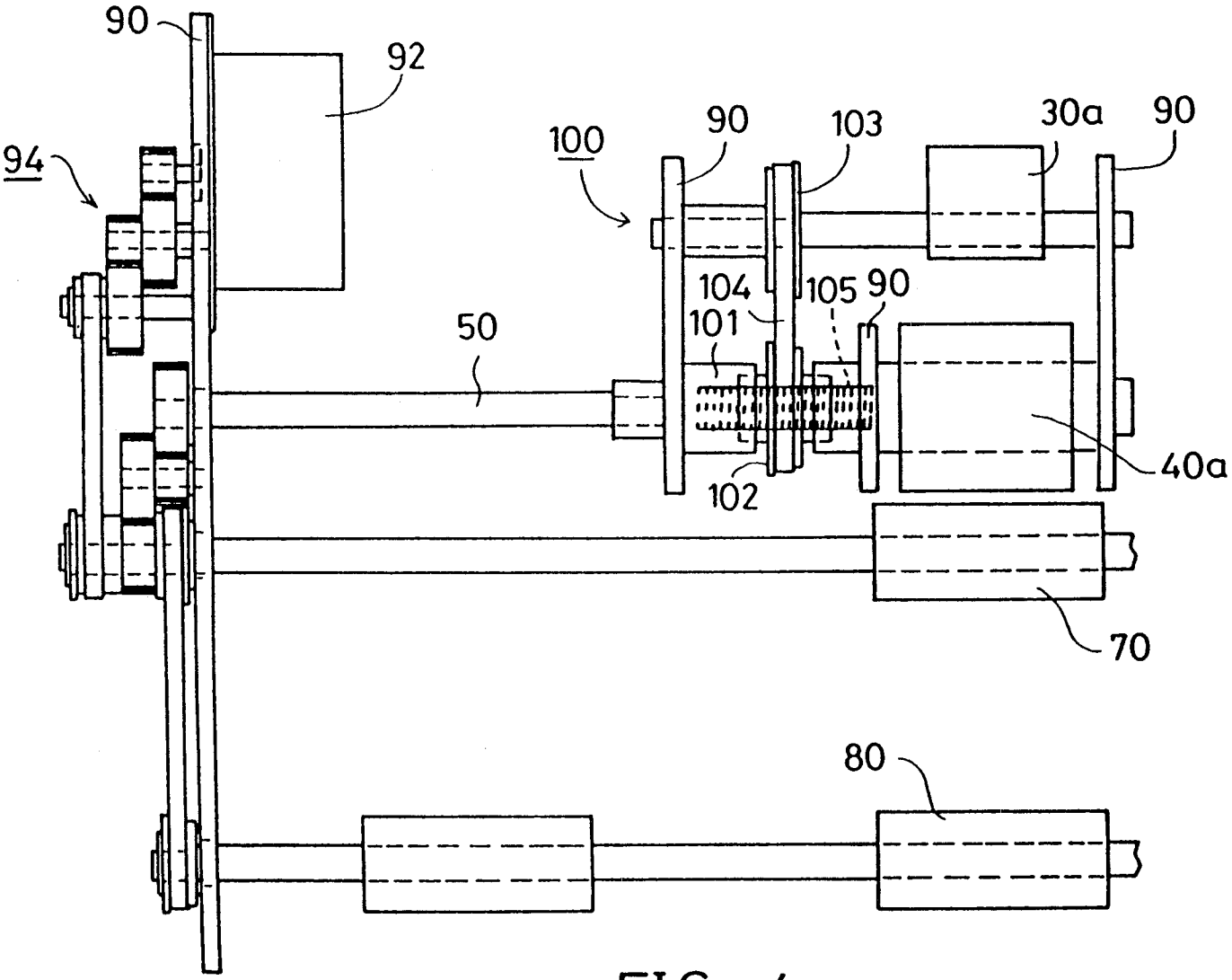
FIG. 4 shows the top elevation of the automatic document feeder of the embodiment of the present invention.
Figure 5:
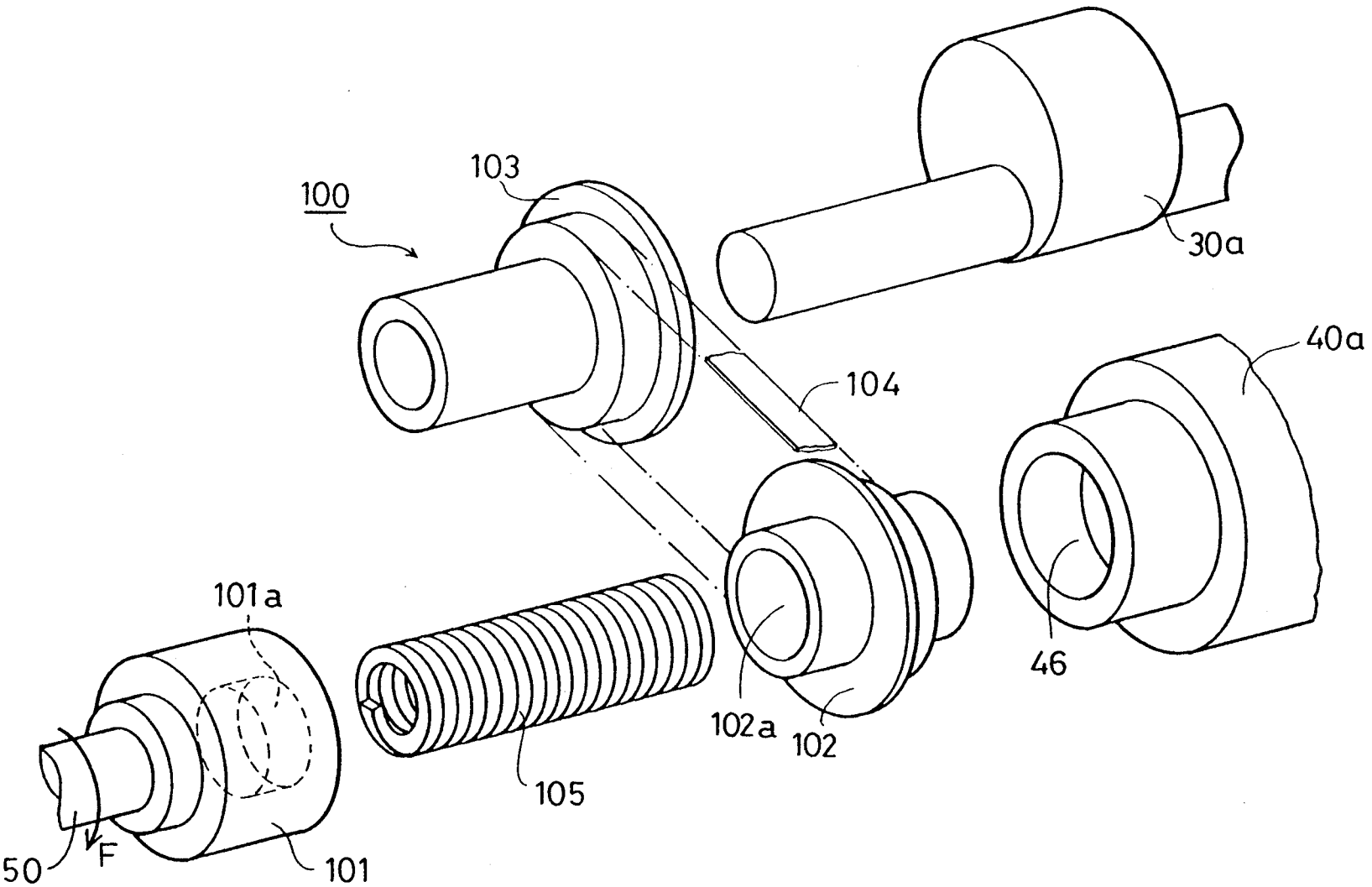
FIG. 5 shows the perspective exploded view of the automatic document feeder of the embodiment of the present invention shown in FIG. 3.

A preferred embodiment of the present invention is shown in FIGS. 3, 4 and 5. The automatic document feeder according to the present invention is adapted to transport document sheets from a document tray 22 to a downstream document outlet tray 24. The automatic document feeder has a feeding roller 30*a*, a dividing roller 40*a*, a driving shaft 50, a scanning roller 70, and an outlet roller 80. The feeding roller 30*a* is mounted on a shaft 34 which is disposed downstream the document tray 22, for urging the document sheets downstream. The dividing roller 40*a* is disposed downstream the feeding roller 30*a*. The dividing roller 40*a* receives the document sheets from the feeding roller 30*a*, then separates and urges one of the document sheets downstream. The riving shaft 50 is coaxially disposed with the dividing roller 40*a*. The scanning roller 70 is disposed downstream dividing roller 40*a*. The scanning roller 70 receives the document sheet from the dividing roller 40*a*, and drives the document sheet at a constant speed so that the document sheet can be scanned accurately. The outlet roller 80 is disposed between the scanning roller 70 and the outlet tray 24. The outlet roller 80 receives the document sheet from the scanning roller 70, and urges the document sheet downstream to the outlet tray.

The above mentioned members are all mounted or disposed on a frame 90 of the fax machine. A motor 92 and a transmission 94 are also mounted on the frame 90. The motor drives the driving shaft 50, the scanning roller 70, and the outlet roller 80 via the transmission 94, as shown in FIG. 4. A feeding press roller 34, a scanning press roller 72, and an outlet press roller 82 are rotatably mounted on the frame 90, as shown in FIG. 3. A dividing press pad 42 is disposed on the frame 90. The feeding press roller 32, the dividing press pad 42, the scanning press roller 72, and the outlet press roller 82 are all spring biased to press on the feeding roller 30*a*, the dividing roller 40*a*, the scanning roller 70, and the outlet roller 80 respectively, in order to facilitate smooth and precise paper transportation.

FIG. 4 shows the perspective exploded view of the clutch 100 of the preferred embodiment of the present invention. The structure of the clutch 100 is a characterized feature of the present invention. The clutch 100 includes a socket 101, a first pulley 102, a second pulley 103, a coil spring 105, and a belt 104. The socket 101 is mounted on the driving shaft 50 and rotates therewith. The socket 101 has a circular recess 101*a* at its one end. The inner diameter of the circular recess 101*a* is equal to the outer diameter of the coil spring 105. The first pulley 102 has a coaxial through hole 102*a*. The inner diameter of the through hole 102*a* is equal to the outer diameter of the coil spring 105. The first pulley 102 is rotatably mounted on and slightly close fitted to the coil spring 105 between the socket 101 and the dividing roller 40*a*. One end of the dividing roller 40*a* has a circular recess 46. The inner diameter of the circular recess 46 is equal to the outer diameter of the coil spring 105. One end of the coil spring 105 is received in and slightly close fitted to the circular recess 46 of the dividing roller 40*a*. The other end of the coil spring 105 is received in and slightly close fitted to the circular recess 101*a* of the socket 101. The second pulley 103 is mounted on the feeding roller 30*a* and rotates therewith. The winding direction of the coil spring 105 is the same as the rotational direction of the driving shaft 50 (denoted by an arrow F). A belt 104 is mounted on the first pulley 102 and the second pulley 103. The diameters of the first pulley 102 and the second pulley 103 are equal. Consequently, the first pulley 102 and the second pulley 103 rotate at a same speed. It should be noted that the transmission 94 and the scanning roller 70 and the dividing roller 40*a* are so designed that the rotating speed of the outer periphery of the scanning roller 70 is greater than that of the dividing roller 40*a*.

The operation of the preferred embodiment of the automatic document feeder according to the present invention will be discussed hereinbelow.

When the scanning operation begins, the motor 92 urges the driving shaft 50, the scanning roller 70 and the outlet roller 80 to rotate via the transmission 94. The driving shaft 50 urges the socket 101 to rotate. Because the rotational direction of the socket 101 (denoted by the arrow F) is the same as the winding direction of the coil spring 105, the coil spring 105 will be enlarged in its diameter such that the first pulley 102 and the dividing roller 40*a* are engaged with the coil spring 105. As a result, the dividing roller 40*a* and the first pulley 102 are urged to rotate with the driving shaft 50. Simultaneously, the first pulley 102 drives the second pulley 103 and the feeding roller 30*a* via the belt 104. After that, the document sheets are transported to the diving roller 40*a* from the document tray 22 by the feeding roller 30*a*. One of the document sheets is urged downstream to the scanning roller 70 by the dividing roller 40*a*. The scanning roller 70 urges the document sheet downstream at a greater speed because its outer periphery runs faster than the outer periphery of the dividing roller 40*a*. The scanning roller 70 thus drags the document sheet and urges the dividing roller 40*a* to rotate faster so that the coil spring 105 is urged to retract in its diameter, whereby the first pulley 102 and the dividing roller 40*a* are disengaged from the socket 101. As a result, the feeding roller 30*a* stops and does not conflict with the scanning operation. After the document sheet is scanned over, it is transported to the outlet tray 24. Since the dividing roller 40*a* is no longer urged by the scanning roller 70, it slows down. After the rotational speed of the dividing roller 40*a* is lower than that of the socket 101, the dividing roller 40*a* and the feeding roller 30*a* engage with the socket 101 again, causing the subsequent document sheet to be sent in for scanning. The same operational procedure is repeatedly performed until the last document sheet is scanned.

While the invention has been described by way of a preferred embodiment, it is to be understood that the invention need not be limited to the disclosed embodiment. On the contrary, it is intended to cover various modifications and similar arrangements included within the spirit and scope of the appended claims, the scope of which should be accorded the broadest interpretation so as to encompass all such modifications and similar structures.

What is claimed is:

1. An automatic document feeder for use in a fax machine to feed a document of at least one printed sheet for fax transmission, said feeder comprising:

(a) a document tray for holding the document;

(b) a feeding roller, disposed downstream said document tray, for urging the document downstream;

(c) a dividing roller, disposed downstream of said feeding roller, capable of allowing only one printed sheet of the document to pass therethrough at a time, said dividing roller having a first outer periphery;

(d) first driving means for rotating a driving shaft;

(e) clutch means for engaging or disengaging said driving shaft to said feeding roller and said dividing roller, said clutch means including:

(1) a coil spring having a first end with a first diameter and a second end with a second diameter said coil spring being arranged with a predetermined winding direction, (2) a socket affixed to one end of said driving shaft, said socket being connected with the first end of said coil spring;

(3) a first pulley securely engaged to one end of said feeding roller, (4) a second pulley securely engaged to one end or said dividing roller, said second pulley having means capable of engaging with the second end of said coil spring due to a first type torsional deformation of said coil spring caused by a speed lead of said dividing roller over said driving shaft, and disengaging with the second end of said coil due to a second type torsional deformation of said coil spring caused by a speed lag of said dividing roller behind said driving shaft;

(5) transmission means coupled between said first pulley and second pulley for transmitting the rotation of said second pulley to said first pulley such that said first pulley and said second pulley rotating with a same angular speed, (d) a scanning roller, disposed downstream said dividing roller, for urging each printed sheet passing through said dividing roller into a scanning position, said scanning roller having a second outer periphery;

(e) an outlet roller, disposed downstream said scanning roller, for urging each printed sheet exiting the scanning position out of the fax machine;

(f) second driving means for rotating said scanning roller and said outlet roller, said scanning roller being driven with the tangential speed of said second outer periphery thereof greater than the tangential speed of said first outer periphery of said dividing roller.

2. An automatic document feeder according to claim 1, wherein said engaging means of said second pulley is a circular recess having a diameter equal to the second diameter of the second end of said coil spring so that said second end of said coil spring can be inserted into said circular recess, whereby as the coil spring is expanded due to the first type torsional deformation, the periphery of said coil spring urges against the inner wall of said circular recess of said second pulley such that the coil spring is engaged with the dividing roller, and as the coil spring is constricted due to the second type torsional deformation, the periphery of said coil spring is separated from the inner wall of said circular recess of said second pulley such that the coil spring is disengaged with the dividing roller.

* * * * *